US007639195B2

(12) United States Patent
Chen

(10) Patent No.: US 7,639,195 B2
(45) Date of Patent: Dec. 29, 2009

(54) ANTENNAS FOR ULTRA-WIDEBAND APPLICATIONS

(75) Inventor: Zhining Chen, Singapore (SG)

(73) Assignee: Agency for Science, Technology and Research, Singapore (SG)

( * ) Notice: Subject to any disclaimer, the term of this patent is extended or adjusted under 35 U.S.C. 154(b) by 176 days.

(21) Appl. No.: 11/791,300

(22) PCT Filed: Nov. 22, 2004

(86) PCT No.: PCT/SG2004/000381

§ 371 (c)(1),
(2), (4) Date: Dec. 18, 2007

(87) PCT Pub. No.: WO2006/054951

PCT Pub. Date: May 26, 2006

(65) Prior Publication Data

US 2008/0136730 A1 Jun. 12, 2008

(51) Int. Cl.
*H01Q 11/12* (2006.01)

(52) U.S. Cl. ..... 343/742; 343/741; 343/867

(58) Field of Classification Search ..... 343/741, 343/742, 866, 867
See application file for complete search history.

(56) References Cited

U.S. PATENT DOCUMENTS

| | | | | | |
|---|---|---|---|---|---|
| 2,082,812 | A * | 6/1937 | Worrall | 343/842 |
| 2,283,897 | A * | 5/1942 | Alford | 343/743 |
| 2,324,462 | A * | 7/1943 | Leeds et al. | 343/742 |
| 2,393,981 | A * | 2/1946 | Fuchs | 343/743 |
| 4,160,978 | A * | 7/1979 | DuHamel | 343/742 |
| 6,255,998 | B1 | 7/2001 | Podger | |
| 6,853,342 | B2 * | 2/2005 | Podger | 343/742 |
| 2002/0122010 | A1 | 9/2002 | McCorkle | |
| 2006/0238430 | A1 | 10/2006 | Morioka et al. | |

FOREIGN PATENT DOCUMENTS

| | | | |
|---|---|---|---|
| GB | 2330695 | A | 4/1999 |
| WO | WO 2004/084348 | A1 | 4/2004 |

* cited by examiner

*Primary Examiner*—Tho G Phan
(74) *Attorney, Agent, or Firm*—McDonnell Boehnen Hulbert & Berghoff LLP

(57) ABSTRACT

An antenna comprising a radiating element for transmitting and receiving communication signals is disclosed. A load and a feed are connectable to the radiating element and that the feed is spaced apart from the load. The radiating element is a planar loop having two free ends to which the load and the feed are connected. The load has two distal terminals, one of which is connected to one of the two free ends and the other is provided for connecting to one of grounding and another radiating element.

20 Claims, 2 Drawing Sheets

ANTENNAS FOR ULTRA-WIDEBAND APPLICATIONS

FIELD OF INVENTION

The invention relates generally to antennas. In particular, it relates to planar antennas for ultra-wideband applications.

BACKGROUND

Ultra-wideband (UWB) radio systems transmit and receive communication signals as modulated impulses. The duration of the modulated impulses is typically very short and is of the order of a few fractions of a nanosecond (ns). This allows the modulated impulses to have frequency ranges that are extremely broad, typically of a few gigahertz (GHz). The broad frequency ranges of the UWB radio systems are therefore distinctly different from conventional narrow-band radio systems. This distinction of the UWB radio systems require a unique set of regulations implemented by a regulatory body specifically for communication systems that are based on UWB technology. The regulations limit the radiated power levels and signal spectra of the UWB radio systems in order to facilitate undue interference to the conventional narrow-band radio systems which occupy a part of the frequency spectrum of the UWB radio systems.

One such regulation, as stipulated by the US Federal Communication Commission (FCC), requires that the emission levels and spectra of the radiated pulses of a UWB radio system to have an effective isotropic radiated power (EIRP) below −41.3 dBm/MHz for a 10 dB bandwidth that covers a frequency range from 3.1 to 10.6 GHz. This regulation defines a spectral limit mask for all UWB radio systems.

Previous studies have shown that emission and reception patterns of a UWB radio system are significantly affected by its antenna characteristics. Therefore, the emission and reception patterns of the UWB radio system are typically modified to conform to FCC emission regulation on the limit mask by appropriately designing the antenna characteristics.

Besides meeting the limit mask regulation, antennas of a UWB radio system should be designed to fulfill a number of requirements. Firstly, the UWB radio system has a bandwidth that is as broad and well-matched as possible for achieving broadband capability and attaining high system efficiency. Secondly, operating power of the UWB radio system is as low as possible for attaining high power efficiency. Thirdly, the UWB radio system has a linearised phase transfer response for providing minimal signal distortion. Finally, the UWB radio system generates radiated pulses with maximum power in a desired direction.

Numerous attempts have been made to fulfill the requirements through various designs of antennas for the UWB radio system. More notable examples are transverse electromagnetic mode (TEM) horns and self-supplemental antennas, such as spiral antennas. Both types of antennas feature very broad and well-matched bandwidths. However, pulses generated by both types of antennas are distorted and suffer from dispersion due to frequency-dependant changes in their respective phase centers.

Bi-conical and disk-conical antennas have less distortion and have relatively stable phase centers for achieving a broad and well-matched bandwidth. This is because resistive loadings are used to eliminate reflection of radiated pulses occurring at transmission ends of both antennas. However, both antennas are bulky in size and are thus unsuitable for small and portable UWB devices.

In conjunction with the abovementioned requirements for a UWB radio system, another important consideration for designing a UWB antenna is the preclusion of interference to conventional in-band or out-band radio systems. The UWB antenna is required to function as an efficient radiator that precludes interference to in-band systems such as W-LAN operating at 5.2 or 5.8 GHz or out-band systems operating at 0.99 to 3.1 GHz.

Further attempts have been made to provide UWB antennas with broadband capability and compliancy with requirements for non-interference with existing in-band and out-band radio systems. In U.S. Pat. No. 6,437,756, Schantz teaches a notched planar monopole to attain band-notched characteristics with a well-matched bandwidth for a voltage standing wave ratio (VSWR) of less than 2:1. However, the well-matched bandwidth is not sufficiently broad for UWB applications.

In U.S. patent application 2003/0090436 A1, a shorted planar monopole having a shorting pin at the bottom of the monopole is proposed by Schantz et al. for size reduction. However, in order to maintain radiation efficiency, the shorting pin and a feed to the monopole are separated far apart, thus rendering the lateral size of the monopole large. The bandwidth of the monopole is also not broad enough for UWB applications.

In U.S. patent application 2002/0122010, McCorkle proposes using a small annular planar monopole to achieve a broad and well-matched bandwidth. However, the annular planar monopole does not exhibit band-notched characteristics for the fulfillment for non-interference with existing in-band and out-band radio systems.

There is therefore a need for an antenna for a UWB radio system which is dimensionally small and for improving system efficiency and reducing interference with existing radio systems.

SUMMARY

Embodiments of the invention are disclosed hereinafter for UWB applications having a small dimensional size for improving system efficiency and for reducing interference with existing radio systems. In particular, an electrical load is positioned in proximity to a feed to provide a bandwidth spectrum with a specified notched band.

In accordance with one aspect of the invention, there is disclosed an antenna for ultra-wideband applications, the antenna comprising a radiating element for transmitting and receiving communication signals. A load and a feed are connectable to the radiating element and that the feed being spaced apart from the load by a predetermined distance. The radiating element is a planar loop having two free ends. The load has two distal terminals, one of the two distal terminal being connected to one of the two free ends of the planar loop and the other distal terminal of the load and another terminal of the feed are provided for connecting to one of grounding and another radiating element. The two distal terminal of the load being spaced apart by a predetermined separation.

In accordance with another aspect of the invention, there is disclosed a method for configuring an antenna for ultra-wideband applications, the method comprising the steps of providing a radiating element having a center opening and two free ends. The two free ends are connectable to a load and a feed, wherein the load and the feed each has a terminal connectable to one of grounding and another radiating element and the radiating element is spatially continuous between the load and the feed.

BRIEF DESCRIPTION OF DRAWINGS

Embodiments of the invention are described in detail hereinafter with reference to the drawings, in which.

DETAILED DESCRIPTION

Figure 1A:
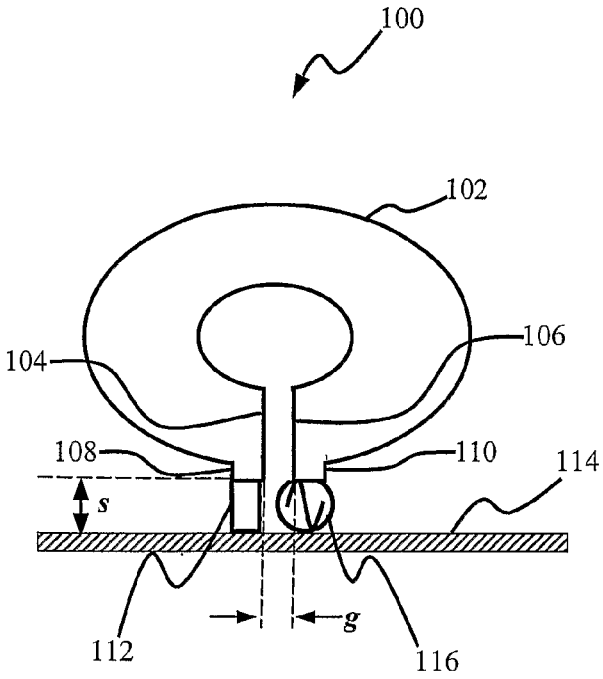
FIGS. 1A and 1B are schematic views of a monopole and a dipole respectively according to a first embodiment of the invention having annular radiating elements.

With reference to the drawings, antennas that are dimensionally small for ultra-wideband (UWB) applications according to embodiments of the invention are disclosed for improving system efficiency and reducing interference with existing radio systems.

Various conventional methods for designing a UWB antenna have previously been proposed. These conventional methods have limited improvement in system efficiency or reduction in interference with existing radio systems. Other conventional methods of designing the UWB antenna suggest a need for large antenna dimensions.

For purposes of brevity and clarity, the description of the invention is limited hereinafter to UWB applications. This however does not preclude embodiments of the invention for other applications that require similar operating performance as the UWB applications. The functional principles fundamental to the embodiments of the invention remain the same throughout the various embodiments.

In the detailed description provided hereinafter and illustrations provided in FIGS. 1A to 1B and 3A to 4B of the drawings, like elements are identified with like reference numerals.

Embodiments of the invention are described in greater detail hereinafter for an antenna for ultra-wide band (UWB) applications.

FIG. 1A shows the geometry of an antenna 100 according to a first embodiment of the invention for UWB applications. The antenna 100 is a monopole having a radiating element 102 with a center opening for transmitting and receiving communication signals to and from another antenna. The antenna 100 is preferably planar and fabricated monolithically on a substrate, such as a printed circuit board (PCB) or an integrated circuit (IC) chip. The communication signals comprise pulse signals having a bandwidth of a few gigahertz (GHz).

The radiating element 102 is formed in the shape of an annular loop, wherein the annular loop is not closed and has at least two end portions 104, 106. The center opening of the radiating element 102 is preferably annular and concentric with the radiating element 102. Two substantially parallel free ends 108, 110 extend from the end portions 104, 106, respectively, of the annular loop away from the center opening of the radiating element 102. The extension for which the two free ends 108, 110 extend from the end portions 104, 106 of the annular loop is inversely proportional to the operating frequency of the antenna 100. Specifically, the larger the size of the extension corresponds to a lower operating frequency of the antenna 100. The amount of extension of the two free ends 108, 110 also affects the impedance matching characteristic of the antenna 100.

The end portions 104, 106 and the two free ends 108, 110 are spaced apart by a first predetermined distance g and maintained therethroughout. Given the limitations of controlling dimensions during the fabrication of the antenna 100, the first predetermined distance g is variably dependable on a given requirement for impedance matching of the antenna 100. In this first embodiment of the invention, the first predetermined distance g is preferably but not limited to approximately 0.5 mm. The radiating element 102 is dimensionally dependable on an inner radius $r_1$ and an outer radius $r_2$ and has a substantially uniform width of $r_2$-$r_1$ therethroughout the annular loop. The outer radius $r_2$ is preferably approximately 7.5 mm. The radiating element 102 is preferably fabricated with conductive material, for example copper.

An electrical load 112 having a first and second terminal has one of the first and second terminal connected to the free end 108 of the radiating element 102. The electrical load 112 can be a passive or active element for providing a resistive or reactive loading, depending on other elements used for forming the antenna 100. The other of the first and second terminal of the electrical load 112 is connected to ground via a ground plane 114. The radiating element 102 is connectable to the ground plane 114 through the electrical load 112 for forming a monopole. The transmission and reception functionality of the antenna 100 is substantially independent of the orientation between the radiating element 102 and the ground plane 114. The spacing between the free end 108 of the radiating element 102 and the ground plane 114 defines a second predetermined distance s. The second predetermined distance s is dependable on the dimension of the electrical load 112 and is preferably kept at a minimal. For example, when a shorting load is used, the second predetermined distance s is zero. When a lump load, such as a chip resistor is used, second predetermined distance s is dependent on the dimension of the chip resistor.

A feed 116 is connected at one terminal to the free end 110 of the radiating element 102 for transferring of communication signals to the antenna 100. The feed 116 is spaced apart from the load 112 by the first predetermined distance g. The feed 116 can be balanced or unbalanced and provides alternating current to the radiating element 102 for the generation of modulated impulses. The other terminal of the feed 116 is connected to ground via the ground plane 114.

The configuration of the radiating element 102 facilitates the attainment of broadband capabilities, which is dependable on the physical geometry of the antenna 100. During the operation of the antenna 100, the electrical load 112 and the feed 116 each carries an alternating current that is out-of-phase from one another. Superposition of signal radiation generated from the electrical load 112 and the feed 116 causes cancellation of the radiation at a particular frequency region of the operating bandwidth of the antenna 100. This is because the electrical load 112 and the feed 116 are in proximity to each other and are carrying out-of-phase alternating currents.

Figure 1B:
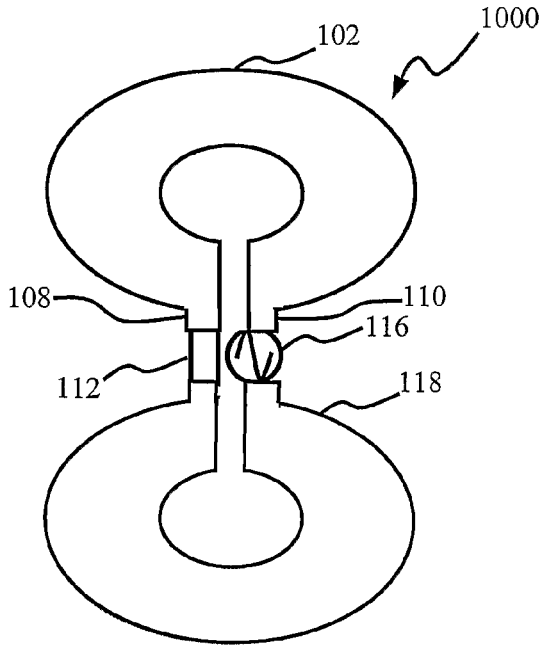

In FIG. 1B, a dipole 1000 of the first embodiment of the invention is formed by connecting another radiating element 118 to the electrical load 112 and feed 116 of the radiating element 102 in place of the ground plane 114. The feed 116 preferably has a differential feeding structure for providing both the radiating elements 102, 108 with currents that are substantially similar in magnitude. The other radiating element 118 is substantially symmetrical to the radiating element 102. The dipole 1000 has similar performance characteristics as the antenna 100.

Figure 2:
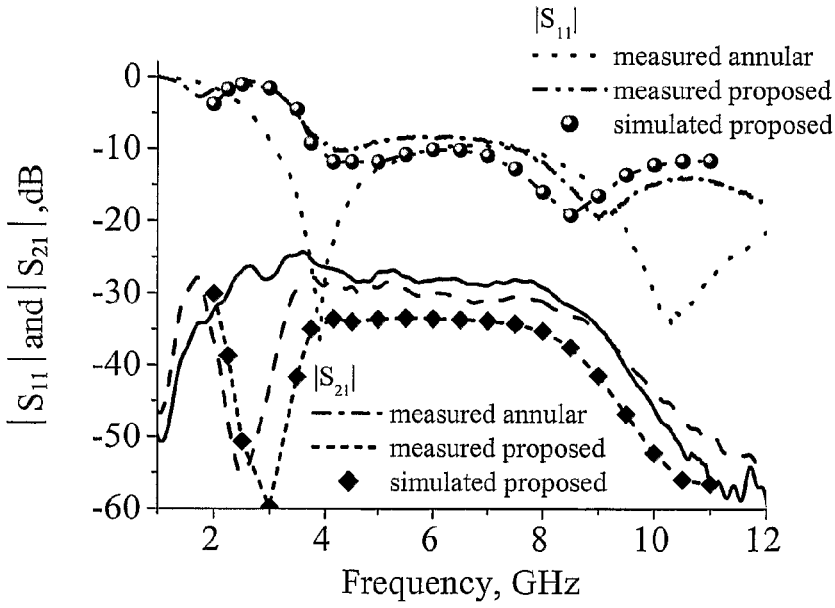
FIG. 2 is a plot showing impedance matching and transfer function characteristics of the monopole of FIG. 1A.

FIG. 2 is a graph that shows measured and simulated test results of the impedance matching and transfer function characteristics of the antenna 100 of FIG. 1A. An annular antenna (not shown) having the same loop dimensions as the radiating element 102 but without the electrical load 112 connected thereto is also measured for comparison purposes. The impedance matching and transfer function of the antenna 100 are simulated and measured over a UWB bandwidth with a frequency range of approximately 1 to 12 GHz.

The measured and simulated test results show the antenna 100 having a well-matched impedance matching characteristic throughout the frequency range of 1 to 12 GHz.

The transfer function characteristics, more specifically the frequency response, of the antenna 100 and the annular antenna are represented by $|S_{21}|$. The frequency response of the antenna 100 has a notched band at the lower frequency range of the UWB bandwidth. This notched band is not apparent for the annular antenna. The notched band facilitates the preclusion of interference with other existing radio system and is preferably alterable for specific regulatory requirements. The alteration is achievable by modifying the physical dimensions such as the first predetermined distance g of the antenna 100.

In this first embodiment of the invention, the notched band appears near a lower bandwidth edge of approximately 3.1 GHz. The notched band may be altered to appear in other desired frequency range such as 5 to 6 GHz while maintaining the frequency response of the antenna 100 for complying with other regulatory requirements. Additionally, the frequency response of the antenna 100 is modifiable by changing at least one of the inner radius $r_1$ and the outer radius $r_2$.

Figure 3A:
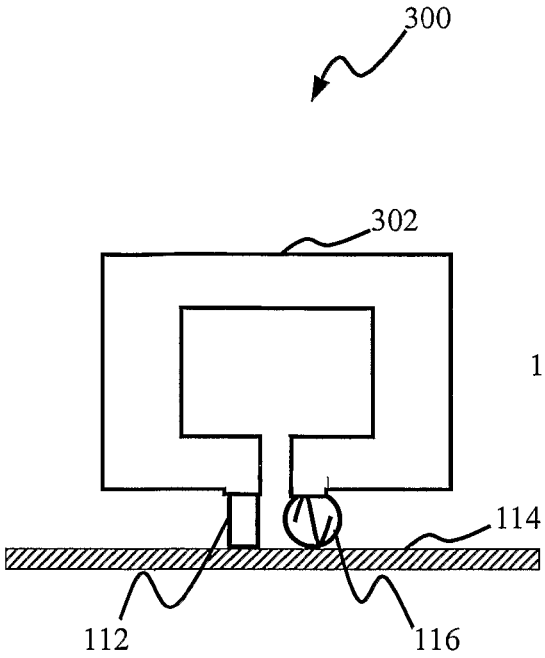
FIGS. 3A and 3B are schematic views of a monopole and a dipole respectively according to a second embodiment of the invention having block shape radiating elements.
Figure 3B:
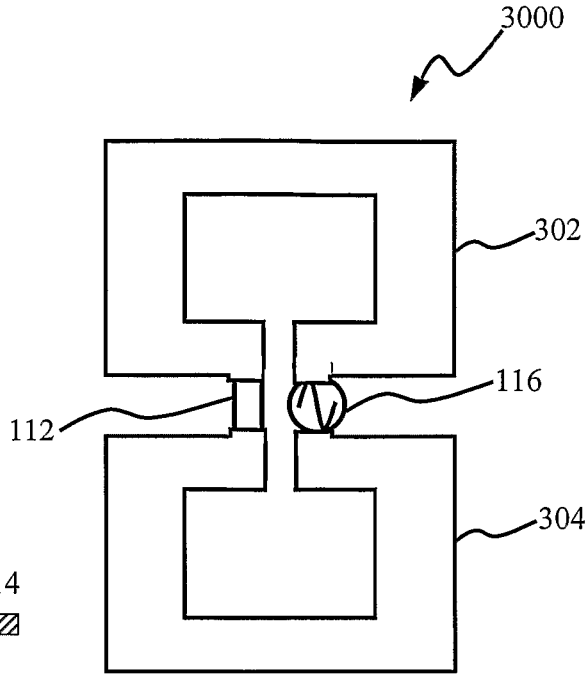

FIGS. 3A and 3B show a second embodiment of the invention in the form of a monopole 300 and dipole 3000 respectively. The radiating elements 302, 306 in the second embodiment of the invention 300, 3000 have geometries of a block-shape loop with a block-shape center opening. The radiating elements 302, 304 perform the same functionality and have similar impedance matching and transfer function characteristics as the first embodiment of the invention 100, 1000.

Figure 4A:
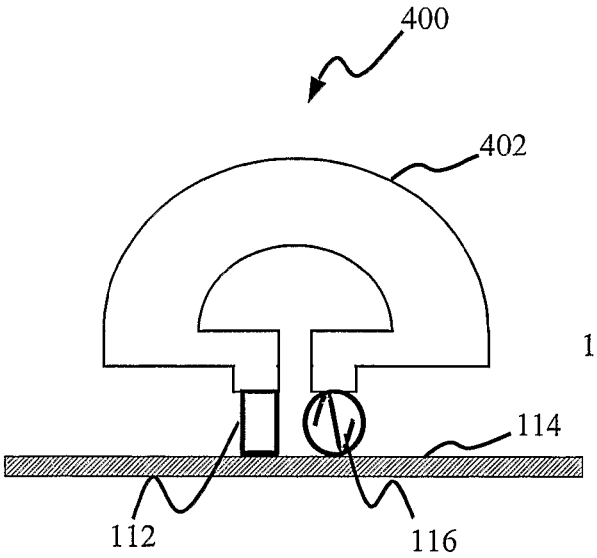
FIGS. 4A and 4B are schematic views of a monopole and a dipole respectively according to a third embodiment of the invention having semi-annular radiating elements.
Figure 4B:
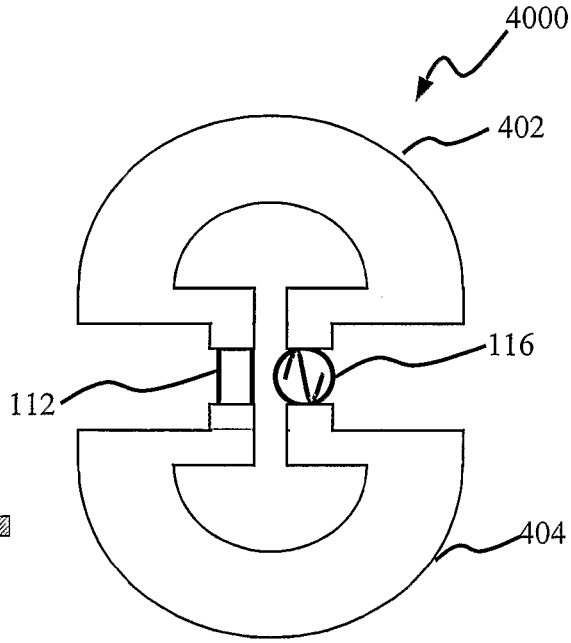

FIGS. 4A and 4B show a third embodiment of the invention in the form of a monopole 400 and a dipole 4000 respectively, wherein the radiating elements 402, 404 are semi-annular loops with semi-annular center opening. Similar to the second embodiment of the invention 300, 3000, the third embodiment of the invention 400, 4000 performs the same functionality and has comparable impedance matching and transfer function characteristics as the first embodiment of the invention 100, 1000.

The various embodiments of the invention are suitable for a wide range of applications, such as UWB wireless communication systems, portable UWB devices and other consumer electronic systems that require antennas for UWB applications. The embodiments of the invention may be applied advantageously to portable UWB systems that require preclusion of interference with other existing communication systems that operates in specific bandwidths. The small physical dimension of the antenna 100 reduces power consumption and has a well-matched broadband capability. Collectively, this results in achieving a UWB radio system having lower power consumption, higher system efficiency and compliant to regulatory requirements.

In the foregoing manner, an antenna having notch band characteristics for UWB applications is disclosed. Although only a number of embodiments of the invention are disclosed, it becomes apparent to one skilled in the art in view of this disclosure that numerous changes and/or modification can be made without departing from the scope and spirit of the invention. For example, the radiating elements may be constructed from conductive materials in other geometrical forms, such as ellipses, triangles, polygons or annuli. Electrical loads may be implemented using passive or active circuit elements in order to attain impedance matching and the feed may be balanced or unbalanced, depending on the use of either a dipole or monopole for antenna implementation.

The invention claimed is:

1. An antenna for ultra-wideband applications, the antenna comprising:

a radiating element for transmitting and receiving communication signals;

a load connectable to the radiating element, the load having a first terminal and a second terminal being substantially distal to the first terminal; and a feed having a terminal connectable to the radiating element, the feed being spaced apart from the load by a first predetermined distance, wherein the radiating element is a planar loop having at least two free ends and the load has first and second terminals, one of the first and second terminals of the load being connected to one of the two free ends of the planar loop and the other of the first and second terminals of the load and another terminal of the feed are provided for connecting to one of grounding and another radiating element, and the two distal terminals of the load being spaced apart by a second predetermined distance.

2. The antenna of claim 1, wherein the other of the first and second terminals of the load and another terminal of the feed are connected to another radiating element.

3. The antenna of claim 2, wherein the radiating element and the other radiating element are substantially symmetrical.

4. The antenna of claim 1, wherein the radiating element is annular.

5. The antenna of claim 4, wherein the radiating element has a center opening.

6. The antenna of claim 5, wherein the center opening is annular and concentric with the radiating element.

7. The antenna of claim 1, wherein the radiating element is spatially continuous between the load and the feed.

8. The antenna of claim 1, wherein the radiating element is laid on a substrate.

9. The antenna of claim 1, wherein the load is one of resistive and reactive.

10. The antenna of claim 1, wherein the load is one of balanced and unbalanced.

11. The antenna of claim 1, wherein the antenna is monolithic.

12. The antenna of claim 1, wherein the frequency response of the antenna is characterised by a band-notch being alterable by dimensions of the radiating element.

13. The antenna of claim 12, wherein the bandwidth of the frequency response of the antenna is maintained during formation of the band-notch.

14. The antenna of claim 1, wherein the first predetermined distance is approximately 0.5 millimeters.

15. The antenna of claim 1, wherein the second predetermined distance is dependable on the dimensions of the load.

16. A method for configuring an antenna for ultra-wideband applications, the method comprising the steps of:

providing a radiating element having a center opening and two free ends;

providing a load having a terminal connectable to one of the two free ends; and providing a feed having a terminal connectable to the other of the two free ends;

wherein each of the load and the feed has another terminal connectable to one of grounding and another radiating element and the radiating element is spatially continuous between the load and the feed.

17. The method of claim 16, wherein the radiating element is substantially annular and connected to ground for forming a monopole.

18. The method of claim 16, wherein each of the other terminals of the load and feed is connected to another radiating element for forming a dipole.

19. The method of claim 18, wherein the feed is differential.

20. The method of claim 16, wherein the radiating element and the another radiating element are substantially symmetrical.

* * * * *